US005289154A

United States Patent [19]

Davis

[11] Patent Number: 5,289,154

[45] Date of Patent: Feb. 22, 1994

[54] FUSE CUTOUT ASSEMBLY AND METHOD

[76] Inventor: Kenneth S. Davis, 1539 S. Helm Ave., Fresno, Calif. 93727

[21] Appl. No.: 51,052

[22] Filed: Apr. 21, 1993

[51] Int. Cl.[5] ..... H01H 71/10; H01H 71/20

[52] U.S. Cl. ..... 337/169; 337/170; 337/173; 337/176

[58] Field of Search ..... 337/168, 169, 170, 171, 337/172, 173, 174, 175, 176, 177, 178, 179, 180, 181, 182, 183, 184, 185, 158, 159

[56] References Cited

U.S. PATENT DOCUMENTS

| | | |
|---|---|---|
| 2,174,477 | 9/1939 | Pittman et al. . |
| 2,315,320 | 3/1943 | Earle . |
| 2,481,298 | 9/1949 | Eldridge, Jr. . |
| 2,516,026 | 7/1950 | Strom et al. . |
| 2,524,101 | 10/1950 | Earle . |
| 2,989,608 | 6/1961 | Hicks . |
| 3,518,483 | 6/1970 | Eason et al. . |
| 3,644,791 | 2/1972 | Carothers et al. . |
| 3,702,419 | 11/1972 | Carothers et al. . |
| 3,889,222 | 6/1975 | Takano et al. . |
| 4,275,372 | 6/1981 | Eley . |
| 4,318,150 | 3/1982 | Eley . |
| 4,503,414 | 3/1985 | Sykes et al. . |
| 4,538,202 | 8/1985 | Ferguson . |
| 4,626,955 | 12/1986 | Cwirzen . |
| 4,688,143 | 8/1987 | Beard . |
| 4,743,996 | 5/1988 | Book . |

*Primary Examiner*—Harold Broome
*Attorney, Agent, or Firm*—Flehr, Hohbach, Test, Albritton & Herbert

[57] ABSTRACT

A fuse cutout assembly (21) including a containment housing (22), a fuse (23), a mounting assembly (24) mounting the fuse (23) in the housing (22) for electrical connection to an electrical circuit. A plunger assembly (29) is movably mounted at least partially inside the housing (22) and preferably surrounding the fuse (23). An electrical conductor (28) is electrically connected to the fuse (23) and mechanically connected to the plunger assembly (29). The plunger assembly (29) is supported in the housing (22) in a first position and is formed to be propelled inside the housing (22) away from the first position to a second position by the hot gases generated upon rapid melting of the fuse (23). Movement of the plunger assembly (29) is preferably yieldably resisted by the air trapped between the plunger assembly (29) and the housing (22), which may be vented during plunger movement. Additional venting (94) for excessive pressure buildup can be provided in the housing (22), and a method of containing the hot gases and metals generated during fuse melting and retaining the components of the cutout assembly (21) is also provided.

24 Claims, 5 Drawing Sheets

FUSE CUTOUT ASSEMBLY AND METHOD

TECHNICAL FIELD

The present invention relates, in general, to electrical fuse assemblies and circuit interrupters, and more particularly, relates to high-voltage fuse cutout assemblies used for the protection of electrical branch distribution systems and transformers.

BACKGROUND ART

High-voltage fuses are widely used by utility companies to protect branch circuits and various electrical equipment, including most frequently transformers. Usually, high-voltage fuses are elongated assemblies in which there is a fusible element surrounded by a material which will help cool and quench the arc resulting when the fusible element rapidly melts. Thus, such fuses often are filled with materials such as sand, boric acid, bone fiber or liquid solutions which will generate water vapor to help cool and quench the arc.

Fusing of the fusible element in a high-voltage fuse generates a considerable volume of high pressure gas and hot metals which are expelled violently from the fuse, which also cools and interrupts or breaks the arc between the terminals which are attached to the fuse. The elongated high-voltage fuse construction spaces the fuse terminals in order to make sustained arcing more difficult. Moreover, various mechanical schemes have been developed for separation of the fuse terminals upon melting of the fusible element. Thus, springs, gravity, explosive charges and the rapid and violent vaporization of arc quenching materials have all been used to separate fuse terminals on melting of the fusible element. Typical of such terminal separating schemes are the fuse cutout assemblies and current interrupters of U.S. Pat. Nos. 2,174,477, 2,315,320, 2,481,298, 2,516,026, 2,524,101, 2,989,608, 3,518,483, 3,644,791, 3,702,419, 3,889,222, 4,275,372, 4,318,150, 4,538,202, 4,626,955, 4,688,143 and 4,743,996.

In general, such fuse cutout assemblies and current interrupting devices pay little attention to the hazards caused by the rapid generation of hot gases and explosive ejection of hot metals and fuse components during generation of such gases. Hot gases, metals and components, however, pose a substantial safety problem in some installations and in the most typical application for fuse cutout assemblies, namely, pole-mounted protection of branch distribution systems and transformers, these hot materials pose a serious fire hazard. In California, for example, utilities are required to clear a space 10 feet in diameter around pole-mounted fuse cutout assemblies.

The problem of containing hot gases and metals on fusing of fusible links has been addressed in connection with isolators for lightening arresters. Lightening arresters are designed to discharge surge currents through the ground and interrupt the flow of dynamic or system currents along the path established by the surge current before the isolator assembly operates. If the lightening arrester does not function properly to cutoff the path to the ground after the surge current has been discharged, the system current follows the surge current to the ground. The isolator assembly, therefore, will heat up, fuse and blow open the circuit thereby clearing the system dynamic following current to the ground. As will be appreciated, however, the surge current which must be dissipated from a lightening strike is very substantial and rises very rapidly, making it extremely difficult for the fusible link to react fast enough and for the housing to contain fusible element components. Thus, a lightening arrester isolator must operate in a manner which is fundamentally different from a fuse cutout assembly. The isolator assembly fusible link must break the circuit almost instantaneously or else the high energy will essentially blow up the isolator. Fuse cutout assemblies, by contrast, are not exposed to such energy and can take longer to melt or fuse.

Bearing the distinction in mind between a fusible isolator assembly for a lightening arrester and a fuse cutout assembly, one isolator device which purportedly contains the resulting hot gases and metals generated when the fusible element melts is shown in U.S. Pat. No. 4,503,414. In this fuse-based isolator assembly, a shielding cup surrounds the fusible member, and upon melting of the fuse, the cup drops down to separate the fuse terminals. The cup also is positioned to catch and contain hot gases and metals produced upon melting of the fuse.

In practice, however, it has been found that the fusible element cannot react fast enough to open the circuit. The result is that the fuse explodes destroying both the spacer and cup, rather than containing the hot gases and metals. The rapid and high energy rise explosively blows the cup away from the remainder of the assembly so that any containment of the arc and hot gases is only temporary, and in every case, the hot shielding pieces are detached from the remainder of the assembly and present a fire hazard.

Accordingly, it is a primary object of the present invention to provide a fuse cutout assembly and method which will replace current liquid fuses, SMU fuses and open link fuses which are presently mounted on transmission line poles and used to protect transformers and branch distribution lines.

It is a further object of the present invention to provide a fuse cutout assembly and method which will be effective in quenching the arc and interrupting the electrical circuit, while at the same time containing substantially all of the hot gases, metals and debris generated during fusing of the fusible element.

Still another object of the present invention is to provide a fuse cutout assembly and method which is constructed in a manner capable of reliably absorbing substantial energy discharge as a result of rapid melting of the fusible element.

Still a further object of the present invention is to provide a fuse cutout assembly and method in which all components will remain attached together during fusing to reduce the fire hazard presented during rapid melting of the fuse.

Another object of the present invention is to provide a fuse cutout assembly and method which is suitable for pole-mounting and can be easily visually inspected from the ground to determine whether it is operable or inoperable.

Still another object of the present invention is to provide a fuse cutout assembly and method which is durable, economical to construct, can be easily retrofit to existing installations and has an improved reliability of operation.

The fuse cutout assembly and method of the present invention have other objects and features of advantage which will be set forth in more detail in the Best Mode of Carrying Out the Invention and will be apparent from the accompanying drawing.

DISCLOSURE OF INVENTION

The fuse cutout of the present invention comprises, briefly, a containment housing, a fuse mounted by a mounting assembly inside the housing for electrical connection by a first terminal to an electrical circuit, a plunger assembly movably mounted at least partially inside the containment housing. The plunger assembly is releasably supported in the housing in a first position and formed to be propelled inside the housing away from the first position to a second position by hot gases generated upon rapid melting of the fuse in order to dissipate energy. Movement of the plunger is preferably pneumatically cushioning and yieldably resisted. The containment housing is formed to substantially contain the hot gases during a movement of the plunger assembly and is formed to retain the plunger assembly against detachment from the fuse cutout assembly.

Most preferably, the containment housing has a substantially closed end and the plunger includes a transversely-extending surface so that movement of the plunger within the housing is resisted by an air cushion inside the housing that must be forced out through bores or passageways through the housing. Still further, the fuse assembly, plunger and housing preferably cooperate to provide a circuitous pathway for fuse gases to travel before they can escape from the housing, ensuring cooling of the gases quenching of the fuse arc. The movable plunger assembly further separates the fuse terminals in order to ensure that the arc is interrupted.

BEST MODE OF CARRYING OUT THE INVENTION

Figure 1:
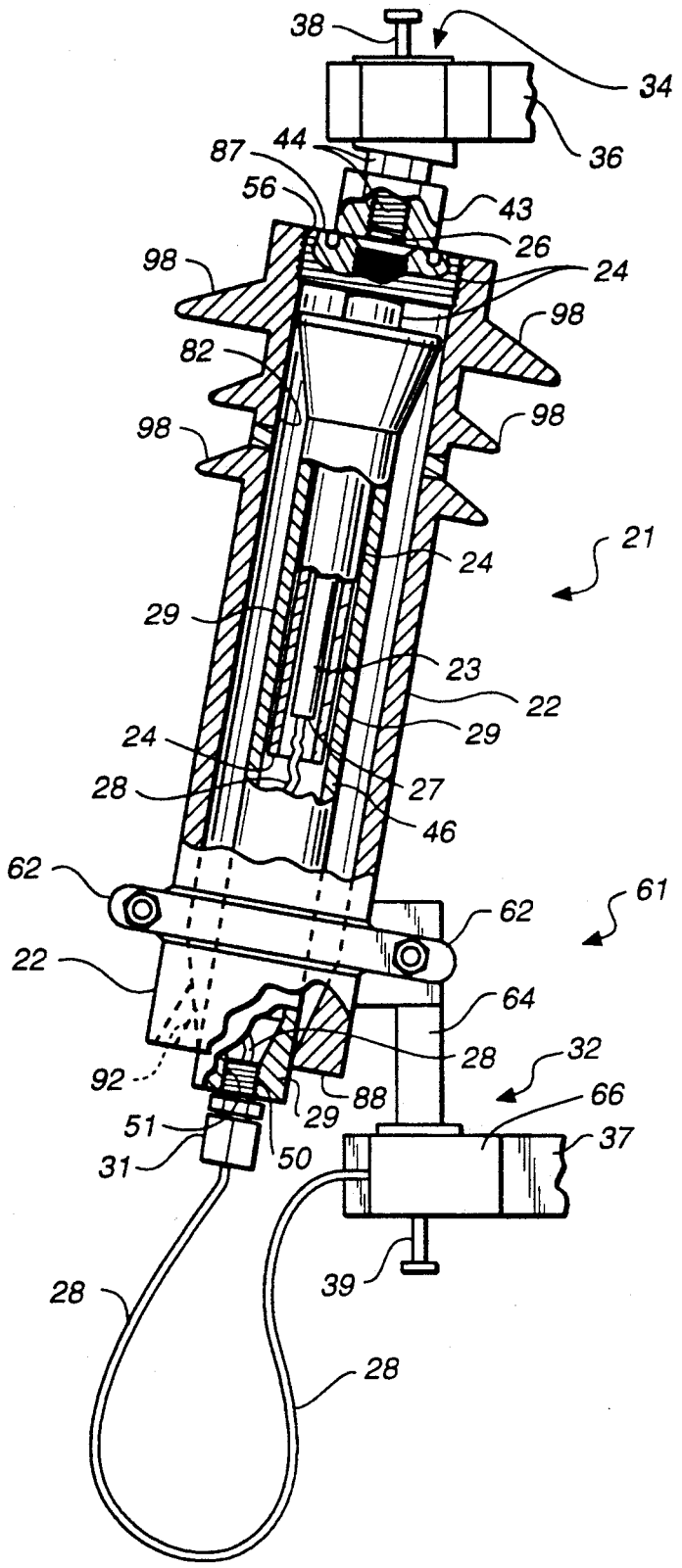
FIG. 1 is a side elevation view, partially broken away and partially in cross-section, showing a fuse cutout assembly constructed in accordance with the present invention.

The fuse cutout assembly of the present invention is particularly well-suited for the protection of high-voltage power distribution branch circuits and electrical apparatus such as transformers. As can be seen by reference to FIG. 1, a fuse cutout assembly, generally designated 21, is provided which includes an elongated tubular containment housing 22 and has a high-voltage fuse 23 mounted therein by fuse mounting means 24. A first fuse terminal 26 is positioned for connection to an electrical circuit and a second fuse terminal 27 is positioned inside housing 22. An electrical conductor 28 is coupled to fuse terminal 27 and extends away from the fuse inside the containment housing to a position which allows connection of the fuse to an electrical circuit (not shown).

In order to both dissipate energy and to produce separation of fuse terminals 26 and 27 when the fusible material in fuse 23 melts, fuse cutout assembly 21 additionally includes a plunger assembly 29 which is movably mounted at least partially inside housing 22. In the preferred embodiment, therefore, fuse 23, mounting tube 24, plunger 29 and housing 22 are all elongated cylinders which are substantially concentrically mounted with respect to each other.

Plunger assembly 29 is releasably supported inside the housing in a first position, as shown in FIG. 1. Most preferably, plunger assembly 29 is supported in housing 22 in the first position of FIG. 1 by mechanically coupling at fitting 31 to the plunger by conductor 28. Thus, when fuse 23 is intact and conductor 28 electrically and mechanically coupled to terminal 27 of the fuse, conductor 28 is mechanically coupled (for example by crimping) to fitting 31 so as to support plunger 29 from fuse 23.

In the preferred form, conductor 28 extends continuously through fitting 31, which has a threaded end 50 threadably engaged in threaded bore 51 of outer end 49 of plunger 29. Fitting 31 can be of the type which will crimp down against the conductor. Conductor 28 extends in a loop to electrically connect to the cutout assembly terminal, generally designated 32. The upper or first fuse terminal 26 in turn is electrically connected by fitting 44 to an upper cutout assembly terminal generally designated 34. The mounting terminals 32 and 34 can include multiple mounting structures so that connection of the cutout assembly to the electrical circuit can be accomplished either through electrically conductive mounting brackets 36 and 37 or by mounting brackets (not shown) which engage the smaller diameter posts 38 and 39. Mounting brackets 36 and 37 can extend to a variety of structures which are typically present in pole-mounted or other installations, such as SMU connectors, ceramic insulators, etc.

Figure 7:
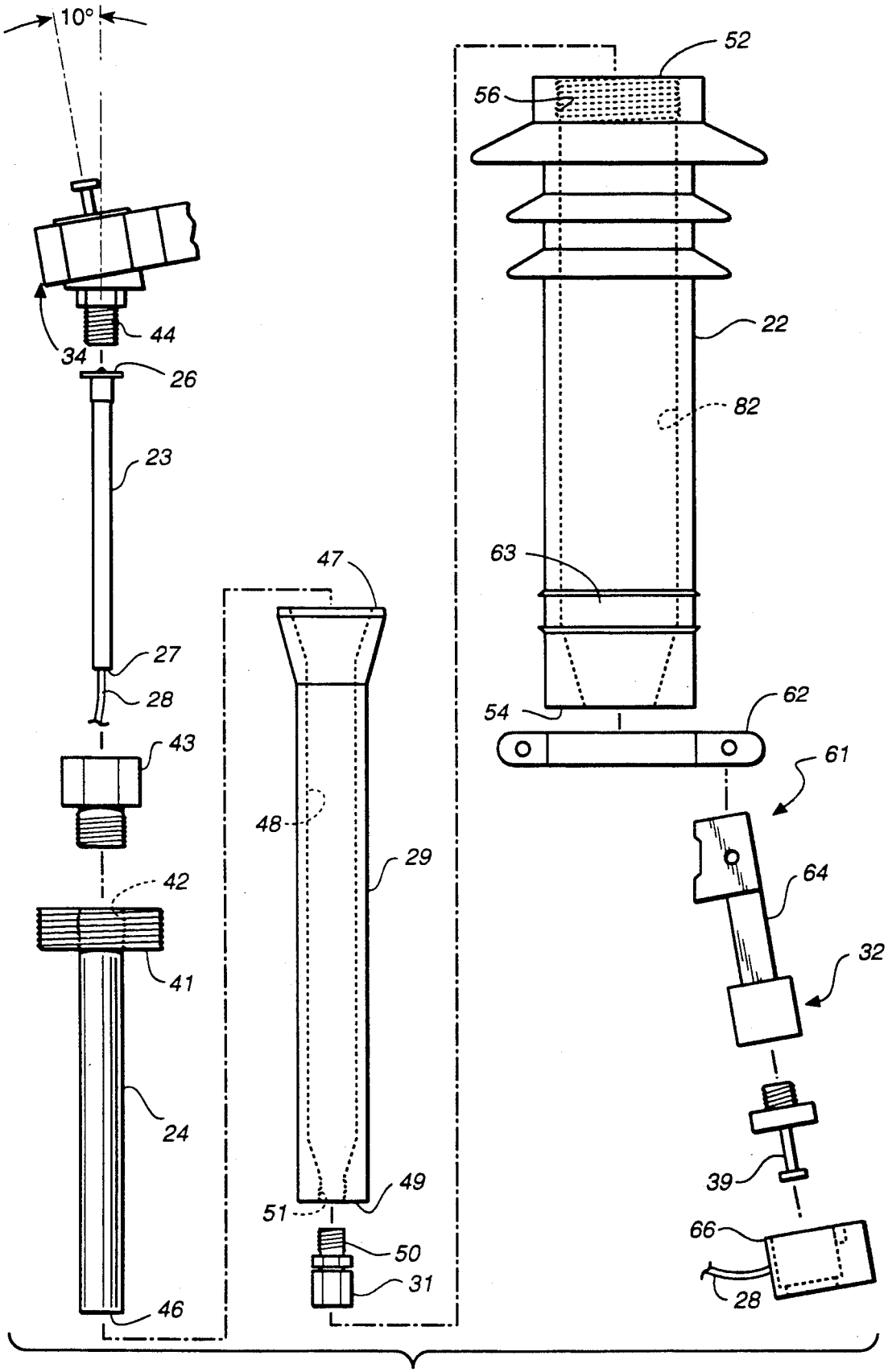
FIG. 7 is an exploded, side elevation view of the components of the fuse assembly of FIG. 1 illustrating the manner in which they are assembled.

Referring now to FIGS. 4–7, the details of construction and the manner of assembly of the components employed in the preferred embodiment can be described. In FIG. 7, fuse 23 can be seen to be any elongated tubular fuse of the kind that is widely employed in high-voltage applications. For example, fuse 23 can be a Type T or Type K fuse having a rating of 25 to 50 amps, or more, and having a first end terminal 26 and a second end terminal 27 to which electrical conductor wire 28 is secured. Such fuses are well-known and come with a pre-attached conductor wire 28.

In order to produce what will be seen to be a circuitous path inside housing 22 and to further shield the shockwaves produced on resilient fusing of the fusible element in fuse 23, it is preferable to mount fuse 23 inside elongated mounting tube 24, which includes an exteriorly-threaded and enlarged upper end 41 and an internally-threaded bore 42. Bore 42 threadably receives fuse seat 43, which in turn receives fuse 23. Seat 43, with fuse 23 in it, therefore, can be screwed down inside the mounting tube bore 42 so that the fuse is concentrically mounted inside the mounting tube and the end terminal 44 screwed inside of the threaded bore of seat 43 until the threaded end 44 is urged into contact with terminal 26 of the fuse. The fitting 44 is electrically conductive and contacts terminal 26 so as to provide an electrical pathway through the cutout assembly to the fuse. Seat 43 can be an insulator, as can be mounting tube 24. As will be seen in FIG. 6, the inner end 46 of mounting tube 24 is open so that the conductor 28 can be urged down the mounting tube and extend outwardly therefrom as shown in FIG. 1.

Next, mounting tube 24, with fuse 23 inside of it, can be inserted into an elongated plunger tube 29 which has an open inner end 47, a bore 48 and a threaded bore 51 in open outer end 49. Conductor 28 extends down and outwardly of outer plunger end 49 so that an electrically conductive fitting 31, having a bore therethrough, can be slipped over conductor 28 and threaded end 50 of the fitting threaded into bore 51. Fitting 31 can then be tightened down on conductor 28 so as to mechanically and electrically connect the conductor to fitting 31.

Next, the fuse, fuse holder and plunger assembly can be mounted inside containment housing 22. The outer end 49 of the plunger is inserted through a first end 52 housing 29 and moved down the internal housing bore 82 until end 49 protrudes outwardly of open second housing end 54. At this point, the exteriorly-threaded enlarged end 41 of the fuse holder will mate with threaded bore 56 at first end 52 of the housing and can be screwed down inside the housing to close end 52 of the containment housing. This positions the fuse inside the housing with end 52 closed by mounting assembly 24 and end 54 closed by plunger 29. The plunger is supported from the fuse by electrical conductor 28.

Finally, the lower mounting bracket assembly, generally designated 61, can be mounted to the exterior of housing 22. A pair of bracket members 62 are clamped around housing receiving groove 63 by fasteners, and terminal support post 64 clamp is also clamped to bracket 62, with the lower end terminal assembly 32 and the mounting adaptation 66 carried thereby. This assembly can be seen in FIG. 1.

The fuse cutout assembly of the present invention features a containment housing and plunger assembly combination which dissipates the high energy released upon rapid melting of the fuse, as well as effects separation of the electrically conductive components so as to terminate arcing and passage of electricity through the assembly. Moreover, the housing 22 is constructed to contain substantially all of the hot gases and metals during the critical melting of the fuse and movement of the plunger, as well as to retain and mechanically secure the plunger so that it cannot become detached and fall away from the assembly.

Operation of fuse cutout assembly 21 and the further details of construction of plunger assembly 29 can now be described by reference to FIGS. 1-3. Fuse cutout assembly 21 will normally be assembled and arranged for protection of an electrical circuit or apparatus as shown in FIG. 1. When the current passing through fuse 23 is above the rated current, the fusible element inside fuse 23 will rapidly melt and vaporize the fuse cooling materials and the fuse housing. An arc will form between terminal 26 and terminal 27 as it attempts to maintain the electrical circuit through the fuse. The reaction is relatively violent, and the arc consumes essentially all of the fuse between the terminals, as well as consuming a portion of conductor 28.

Figure 2:
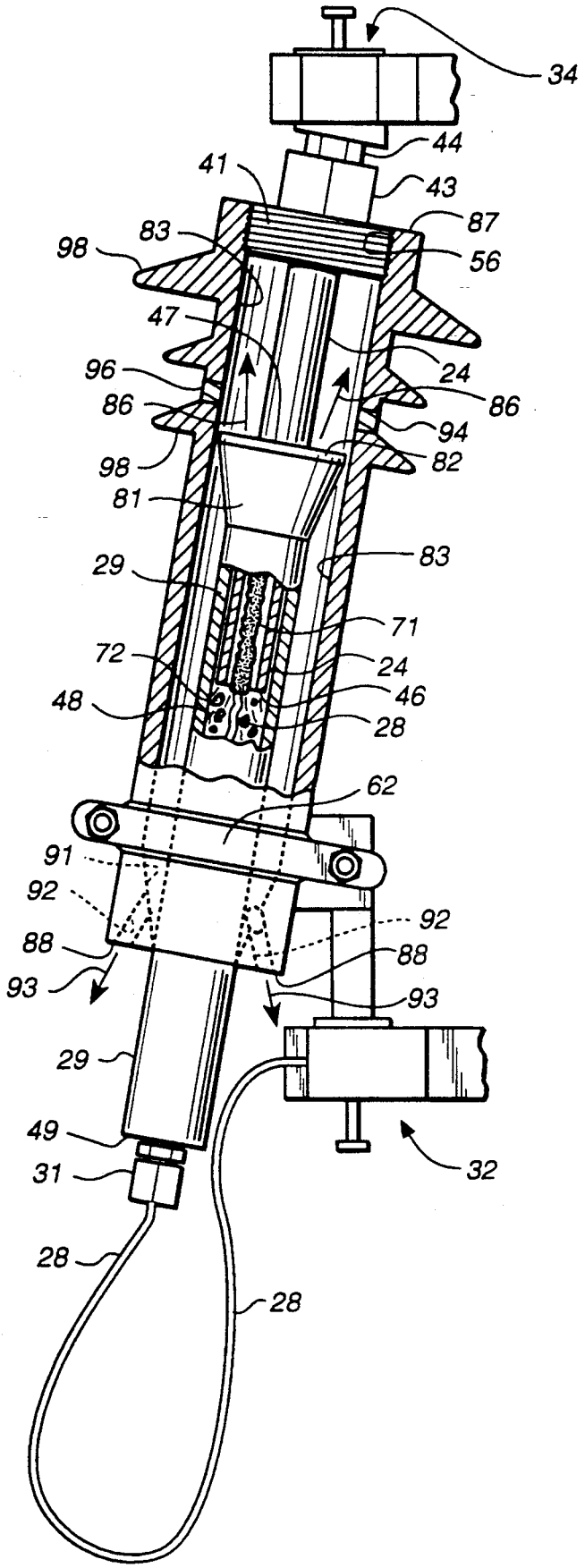
FIG. 2 is a side elevation view corresponding to FIG. 1 showing the fuse cutout assembly of the present invention during arcing of the fuse and movement of the plunger.

This action can be schematically seen in FIG. 2 in which an arc 71 has formed and conductor 28 has receded out of fuse holder tube 24. Violently projected downwardly out of holder 24 will be hot gases and metals represented by 72. These gases are contained initially by plunger 29 and fill the internal bore 48 of the plunger. Gases will be expelled downwardly out of the open end 46 of fuse holder 24 toward outer end 49 of the plunger, which is closed by a fitting 31. The gases will then buildup and escape upwardly around fuse holder 24 and out the enlarged upper end 47 of plunger 29, as indicated by arrows 86.

Figure 5:
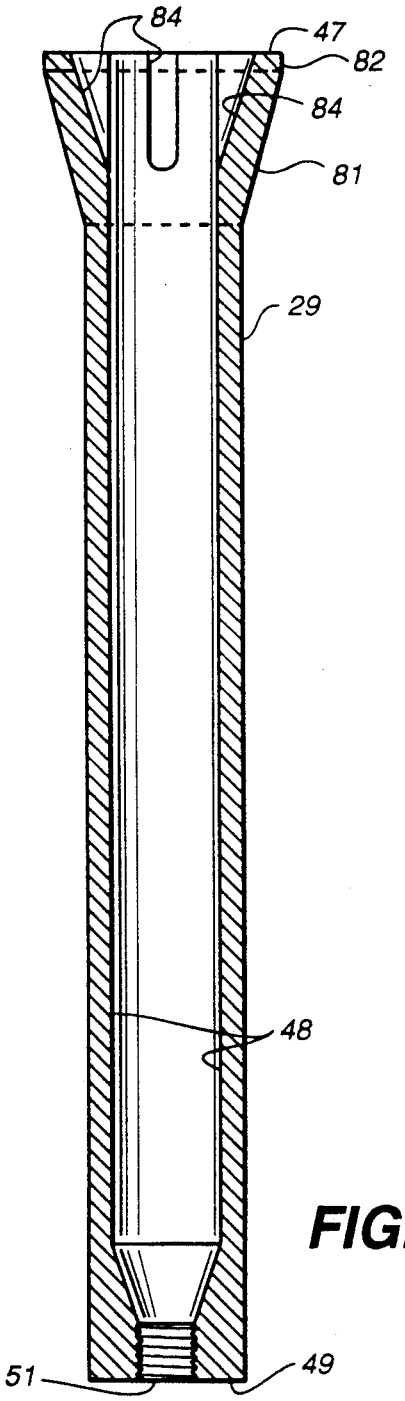
FIG. 5 is a side elevation view in cross-section taken substantially along the plane of line 5—5 in FIG. 4.
Figure 6:
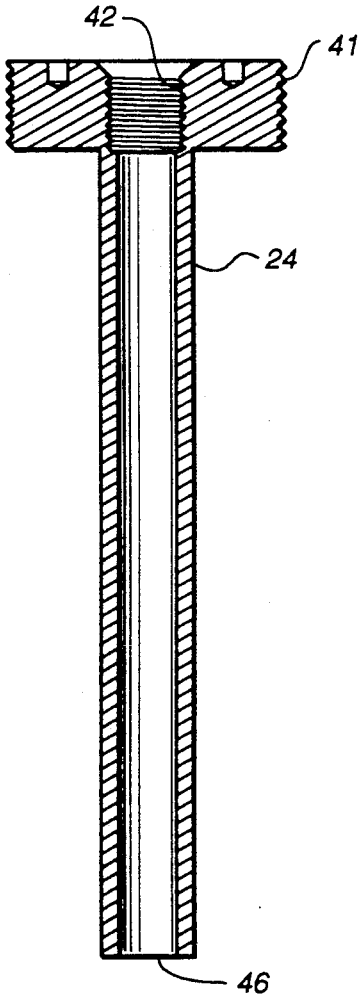
FIG. 6 is an enlarged, side elevation view in cross-section of the fuse holder element of the fuse cutout assembly of FIG. 1.

As can be seen in FIG. 5, the interior of enlarged end 47 is formed with a plurality of tapering grooves or passageways 84 which communicate with central bore 48 in the plunger. The exterior diameter of fuse mounting tube 24 is dimensioned relative to bore 48 so as to provide an annular space between mounting tube 24 and the interior bore 48 of plunger 29. This space permits the passage of hot gases between mounting tube and the wall of plunger 29 defining bore 48 and thereafter out grooves 84 at the large diameter end of the plunger, as indicated by arrows 86 in FIG. 2.

Thus, on melting of fuse 23 and the rapid generation of hot gases, the gases and debris 72 first expand rapidly toward outer end 49 of plunger 29 and then are reversed in a direction to pass rearwardly toward inner end 47 of the plunger for escape out of grooves 84. Since melting of the fusible element in the fuse also destroys the mechanical coupling between the plunger and the fuse, hot gases escaping as indicated by arrows 86, drives plunger 29 away from first end 87 of housing 22 and toward second end 88 of the housing. As will be seen, however, the enlarged end 41 of mounting tube 24 closes first end 87 of the housing and prevents the hot gases discharged through grooves 84 from escaping from the housing.

It is an important feature of the present invention that movement of plunger 29 in housing 22 is yieldably resisted by movement resisting structure so that the energy of the hot gases can be dissipated and shock loading of the plunger when it reaches the end of the housing is minimized. In the preferred form as shown in the drawing, housing 22 and plunger 29 are formed for cooperative pneumatic cushioning of plunger 29 as it advances toward second end 88 of the housing. Thus, end 88 of housing 22 is enclosed or filled by plunger 29 and includes a transversely-extending inner housing surface 91. End 47 of plunger 29, as previously described, has a transversely-extending exterior plunger surface 81 which essentially fills the bore 82 of housing 22. The combination of the plunger and housing, therefore, traps an annular column of air in the housing between surfaces 91 and 81. As plunger 29 moves from a first position shown in FIG. 1 to a second position at the opposite end 88 of the housing, the air in the annular column between surfaces 81 and 91 is compressed.

Figure 3:
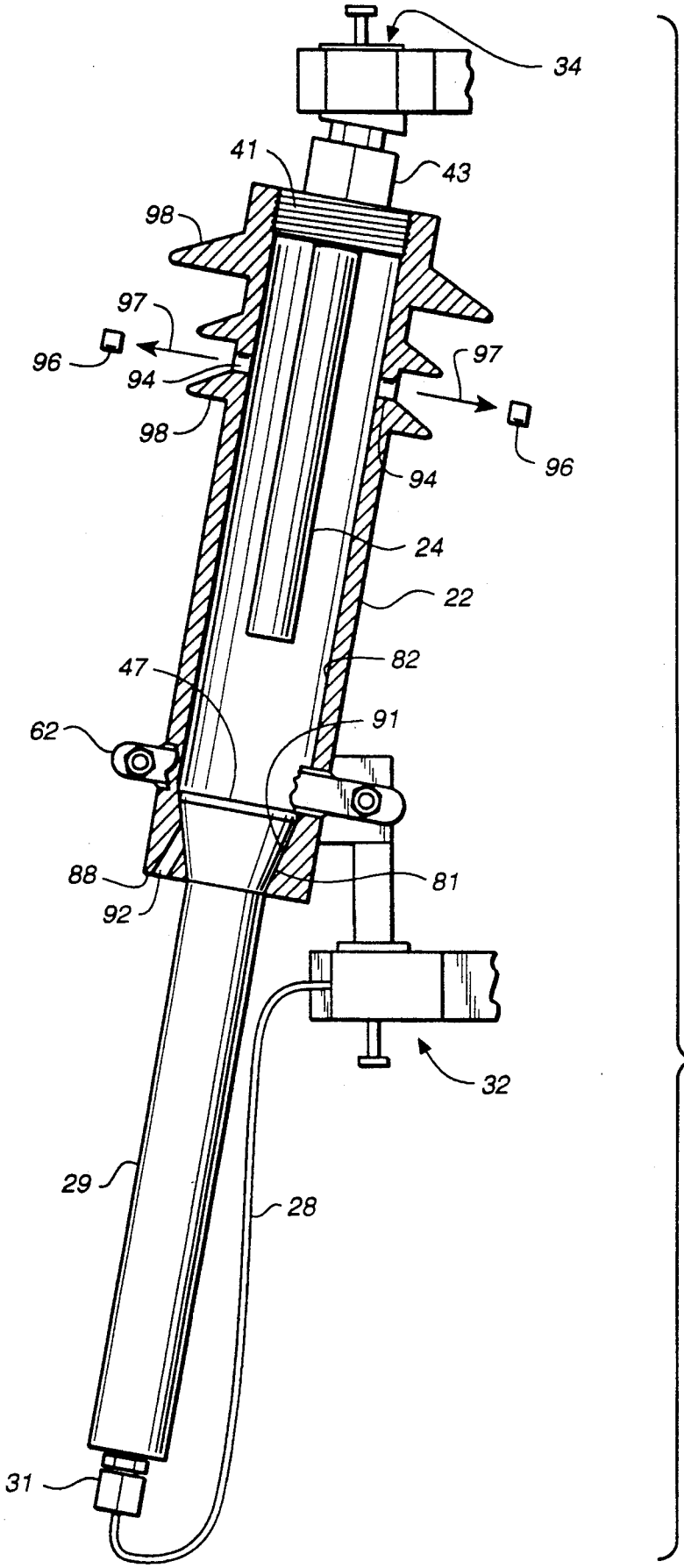
FIG. 3 is a side elevation view corresponding to FIG. 1, but slightly reduced in scale, showing the fuse cutout assembly of FIG. I after completion of displacement of the plunger.
Figure 4:
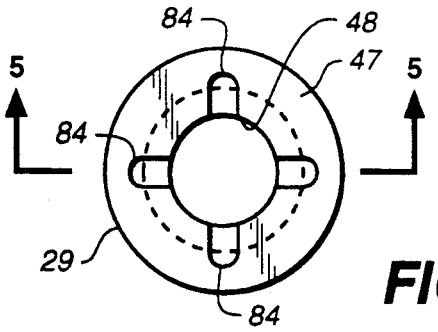
FIG. 4 is an enlarged, end elevation view of the plunger of the fuse assembly of FIG. I.

As will be seen from FIG. 3, transverse surface 91 in the housing and plunger surface 81 preferably are mating frusto-conical surfaces so that they will seat against each other in the second or final position of FIG. 3. It is desirable to allow such seating to occur so as to separate conductor 28, which will be burned back essentially to fitting 31 by the fuse arcing, from upper fuse terminal 26, and to seal the lower end of the housing.

In order to permit the ambient air which forms a pneumatic cushion between surfaces 91 and 81 to be dissipated, and not act as a spring, it is further preferable that the lower end 88 of housing 22 be formed with a bore or passageway 92 which communicates with the interior bore 82 of the housing in which air would otherwise be trapped, for example, by penetrating through frusto-conical surface 91. In the preferred form, the three bores 92 are provided which each extend to frustoconical surface 91. Bores 92 may be balanced around the periphery at about 120° from each other. Each bore 92 can have a size restricting, but not preventing, air escape. Three 0.187 inch diameter bores 92, for example, are used for a typical 25 amp fuse cutout assembly. As indicated in FIG. 2, therefore, as the plunger is propelled rapidly inside housing toward end 88, and air trapped between surfaces 81 and 91 escapes from bores 92, as indicated by arrows 93. It is an important feature of the present invention that such downwardly-escaping air is merely the ambient air found in the fuse cutout assembly and not the hot gases or metals produced by melting of the fuse. Such gases and metals are trapped between the upper end 47 of the plunger and enlarged mounting end 41 of the fuse mounting device 24.

When plunger 29 reaches the second position of FIG. 3, it will also be noted that the bores 92 are closed or substantially sealed by mating frusto-conical surfaces 81 and 91. Moreover and very importantly, the enlarged head 47 of plunger 29 has the advantage of retaining the plunger against detachment from housing 22.

In extreme situations, sufficient gas may be generated in housing 22 so that the volume of bore 82 in housing 22 is not sufficient to safely contain the pressurized gas. It is a further feature of the present invention, therefore, to provide normally closed vent means, which is formed to prevent venting of hot gases from housing 22 except under extreme gas generation. In the preferred form, one or more bores 94 may be provided in housing 22 in which plugs 96 can be releasably mounted. As the pressure and/or temperature build inside the housing 22 beyond a predetermined threshold, plugs 96 can be ejected by the pressure and/or melted or fractured by the hot gas temperature so as to relieve pressure inside housing 22 and prevent destructive explosion of the housing. This is shown in FIG. 3, and arrows 97 show the expulsion of the plugs 96 from bores 94.

Under such extreme conditions, some of the gases produced by fuse melting will escape from housing 92, but such gas escape will occur only after the gases have travelled over a circuitous path out the fuse mounting holder 24, down the interior of plunger 29 and back out the large end 47 of plunger 29 into housing bore 82. At this point, the plunger will also have moved and the gas temperatures will be reduced as a result of expansion and the circuitous path. Thus, while sufficient gas may escape to prevent explosion, the gas is directed laterally, and not downwardly, it is likely to contain no large particles, and it will be substantially cooled. As used herein, therefore, the expression "formed to contain substantially all of the hot gases" shall include housings which vent fuse gases only after containing the gases during movement of the plunger assembly.

As best may be seen from FIGS. 2 and 3, displacement of plunger 29 out of housing 22 is accommodated by a combination of conductor 28 being sufficiently long to be connected to the plunger in a second position of FIG. 3 and by providing a mounting bracket which permits the plunger to pass downwardly from the first position to the second position. In the embodiment shown in the drawing, upper mounting assembly 34 and lower mounting assembly 32 are provided to mount the fuse cutout assembly 21 at a slight angle, in this case 10°, so that the plunger will clear lower mounting assembly bracket 32. Other bracket constructions for mounting the fuse cutout assembly 21 of the present invention to a pole, insulator, and the like can be provided within the scope of the present invention.

As will be apparent from the above description of the apparatus of the present invention, the present apparatus allows the practice of a method of quenching arcing of a fuse and containing the hot gases and metals produced during rapid melting of the fuse. This method can be seen to be comprised of the steps of mounting fuse 23 in a containment housing 22 in a position for connection to an electrical circuit, mounting a plunger assembly 29 inside the housing 22 in a first position in the housing, and propelling plunger assembly 29 inside the housing away from the first position by hot gases produced during rapid melting of fuse 23 while yieldably resisting movement of the plunger assembly in housing 22. The method also includes the steps of containing substantially all the hot gases and metals in housing 22, and retaining the movable plunger attached to the housing so that the plunger is not a fire or other safety hazard. This is preferably accomplished by retaining the enlarged head 47 of plunger 29 by a mating converging surface 91 in housing 22.

The fuse cutout assembly of the present invention as shown in the drawing has been used to dissipate the energy of a 25 amp high-voltage fuse without venting through bores or ports 94 and without fracturing either the housing 22 or plunger 29. The pneumatic cushion between the housing and plunger avoids the high-energy shock loading and makes the housing and plunger and usually mounting tube 24 reusable. The fuse mounting tube 24 also acts as a shock dissipating element during the violent melting and arcing of the fuse.

In the fuse cutout assembly of the present invention, housing 22 can be formed from a glass filled (30–50 percent) thermoplastic, shock-resistance, and self-extinguishing (V.O.-rated under Underwriter Laboratories specification 94) polymer which is non-conductive. General Electric glass-filled, polyester sold under the trademark VALOX is believed to be suitable for this purpose. The exterior of the housing may be provided with a plurality of flanges 98 which resist the tendency of water or condensate from forming an electrical path for the flow of electrical current along the outside of housing 22 when fuse arcing occurs. The flanges 98 cause condensation to drip off of the housing, rather than run along the same, and flanges 98 reinforce housing wall 22 in the area that fuse melting occurs.

Plunger 29 and fuse mounting tube 24 can also be formed of various fire-resistant plastic materials which have good resistance to shock loading and are not electrically conductive.

WHAT IS CLAIMED IS:

1. A fuse cutout assembly comprising:

an electrical fuse;

a containment housing;

a mounting assembly mounting said fuse inside said housing for electrical connection of said fuse in an electrical circuit;

a plunger assembly movably mounted at least partially inside said housing, said plunger assembly being formed and positioned to be propelled inside said housing by hot gases generated upon rapid melting of said fuse; and said housing and plunger assembly being further formed to contain substantially all of said hot gases during movement of said plunger assembly in said housing and being formed to retain said plunger assembly against detachment from said housing.

2. The fuse cutout assembly as defined in claim 1 wherein, said plunger assembly and housing are formed to cooperate to yieldably resist movement of said plunger assembly inside said housing.

3. The fuse cutout assembly of claim 2 wherein, said housing and plunger assembly define a space therebetween and said plunger and housing are formed to force air out of said space as said plunger moves in said housing.

4. The fuse cutout assembly of claim 3 wherein, said housing is formed with a bore therethrough communicating with said space, and said plunger forces air out of said space through said bore.

5. A fuse cutout assembly comprising:

a containment housing;

a fuse;

a mounting assembly mounting said fuse to said housing for electrical connection by a first terminal to an electrical circuit, said fuse extending inside said housing and having a second terminal positioned inside said housing;

a plunger assembly movably mounted at least partially inside said housing;

an electrical conductor electrically connected to said second terminal and electrically and mechanically connected to said plunger assembly;

said plunger assembly being formed for electrical connection of said electrical circuit to said electrical conductor, and said plunger assembly being releasably supported in said housing in a first position and being formed to be propelled inside said housing away from said first position to a second position by hot gases generated upon rapid melting of said fuse; and a movement resisting structure provided in said housing yieldably resisting movement of said plunger assembly from said first position to said second position.

6. The fuse cutout assembly as defined in claim 5 wherein, said movement resisting structure is provided by an enclosed housing end and a transversely-extending exterior plunger surface on said plunger assembly, said housing end and plunger surface cooperating to pneumatically yieldably resist movement of said plunger assembly.

7. The fuse cutout assembly as defined in claim 5 wherein, said plunger assembly is releasably supported in said first position by said electrical conductor.

8. The fuse cutout assembly as defined in claim 5 wherein, said housing is formed to contain substantially all of said hot gases during arcing of said fuse and movement of said plunger assembly.

9. The fuse cutout assembly as defined in claim 5 wherein, said housing is an elongated tubular housing;

said fuse is an elongated fuse;

said mounting assembly is provided by an elongated mounting tube mounted by an outer end to a first end of said housing and extending longitudinally inside said housing to an open inner end; and said fuse is mounted inside said mounting tube, and said electrical conductor extends out from said open inner end of said mounting tube.

10. The fuse cutout assembly as defined in claim 9 wherein, said plunger assembly is provided by an elongated plunger tube substantially surrounding said mounting tube in said first position.

11. The fuse cutout assembly as defined in claim 10 wherein, said plunger tube has an inner plunger end positioned proximate said first end of said housing in said first position and an outer plunger and extending outwardly of a second end of said housing.

12. The fuse cutout assembly as defined in claim 11 wherein, said electrical conductor is mechanically connected to said plunger tube proximate said outer plunger end; and said electrical conductor extends through said outer plunger end for connection to said electrical circuit.

13. The fuse cutout assembly as defined in claim 9 wherein, said housing is substantially vertically oriented, and said first position is above said second position for gravity-aided movement of said plunger assembly upon melting of said fuse.

14. The fuse cutout assembly as defined in claim 5 wherein, said housing is an elongated tubular housing having an inner housing end surface extending transversely to a longitudinal axis of said housing;

said plunger assembly is provided by an elongated plunger tube having outer plunger surface extending transversely to said longitudinal axis of said housing and substantially mating with said inner housing end surface when said plunger assembly is in said second position.

15. The fuse cutout assembly as defined in claim 14 wherein, said housing includes vent means proximate said inner housing end surface.

16. The fuse cutout assembly as defined in claim 15 wherein, said inner housing end surface and said outer plunger surface are both provided by frusto-conical surfaces; and said vent means is provided by at least one bore extending through said housing to the frusto-conical inner housing end surface.

17. The fuse cutout assembly as defined in claim 5 wherein, said housing assembly is provided by an elongated tubular housing member having opposed open ends;

said mounting assembly is positioned in and substantially closes one of said open ends; and said plunger assembly is positioned in said housing and extends through and substantially closes the other of said open ends.

18. The fuse cutout assembly as defined in claim 5 wherein, said plunger assembly is provided by an elongated plunger tube having an open end dimensioned to receive said fuse therein and having a closed end, said open end of said plunger tube being vented in a direction opposite of the direction of movement of said plunger assembly from said first position to said second position in order to propel said plunger tube therebetween by venting of gases from said open end.

19. The fuse cutout assembly as defined in claim 18 wherein, said open end of said plunger tube is positioned proximate a closed end of said housing when said plunger assembly is in said first position.

20. The fuse cutout assembly as defined in claim 5 wherein, said housing includes vent means formed to prevent venting of hot gases from said housing except under conditions of extreme gas generation.

21. A method of quenching arcing of a fuse and containing the hot gases and metals produced during rapid melting of said fuse comprising the steps of:

mounting said fuse in a containment housing in a position for connection of an electrical circuit thereto;

mounting a plunger assembly inside said housing in a first position in said housing and mechanically coupling said plunger assembly to an electrical conductor electrically connected to said fuse;

propelling said plunger assembly and said electrical conductor inside said housing away from said first position by said hot gases produced during rapid melting of said fuse; and yieldably resisting movement of said plunger assembly in said housing and containing substantially all of said hot gases and metals by a combination of said housing and said plunger assembly.

22. The method as defined in claim 21 wherein, said step of yieldably resisting movement of said plunger is accomplished by pneumatically resisting movement.

23. The method as defined in claim 22 wherein, said step of pneumatically resisting movement is accomplished by forcing air in said housing out vent means in said housing by movement of said plunger assembly.

24. The method as defined in claim 21 and the step of:

retaining said plunger assembly against separation from said housing.

* * * * *